US010780310B2

(12) United States Patent
Meredith

(10) Patent No.: US 10,780,310 B2
(45) Date of Patent: Sep. 22, 2020

(54) LEG PRESS EXERCISE MACHINE

(71) Applicant: HOIST FITNESS SYSTEMS, INC., Poway, CA (US)

(72) Inventor: Jeffrey Meredith, Del Mar, CA (US)

(73) Assignee: HOIST FITNESS SYSTEMS, INC, Poway, CA (US)

( * ) Notice: Subject to any disclaimer, the term of this patent is extended or adjusted under 35 U.S.C. 154(b) by 20 days.

(21) Appl. No.: 16/297,260

(22) Filed: Mar. 8, 2019

(65) Prior Publication Data

US 2019/0282848 A1 Sep. 19, 2019

Related U.S. Application Data

(60) Provisional application No. 62/644,829, filed on Mar. 19, 2018.

(51) Int. Cl.

| | |
|---|---|
| ***A63B 21/00*** | (2006.01) |
| ***A63B 21/062*** | (2006.01) |
| ***A63B 23/04*** | (2006.01) |

(52) U.S. Cl.

CPC ..... *A63B 21/151* (2013.01); *A63B 21/0628* (2015.10); *A63B 21/4034* (2015.10); *A63B 23/0405* (2013.01); *A63B 2225/09* (2013.01)

(58) Field of Classification Search

CPC ..... A63B 21/151; A63B 21/0628; A63B 21/4034; A63B 21/068; A63B 21/4045; A63B 21/154; A63B 23/0405; A63B 23/0429; A63B 23/03525; A63B 23/035; A63B 23/0355; A63B 23/04; A63B 23/0417; A63B 23/0423; A63B 23/0441; A63B 23/0447; A63B 23/0452; A63B 2225/09; A63B 2208/0238; A63B 2208/0228; A63B 2023/0441; A63B 2022/0033; A63B 2022/0053; A63B 2244/09

See application file for complete search history.

(56) References Cited

U.S. PATENT DOCUMENTS

| | | | | |
|---|---|---|---|---|
| 5,106,081 | A | 4/1992 | Webb | |
| 5,366,432 | A | 11/1994 | Habing et al. | |
| 5,549,533 | A | 8/1996 | Olson et al. | |
| 5,554,086 | A * | 9/1996 | Habing ..... | A63B 23/03525 482/100 |

(Continued)

OTHER PUBLICATIONS

International Searching Authority, International Search Report and Written Opinion for corresponding International Application No. PCT/US2019/021418, dated May 13, 2019, 9 pages.

*Primary Examiner* — Loan B Jimenez
*Assistant Examiner* — Kathleen Vermillera
(74) *Attorney, Agent, or Firm* — Gordon Rees Scully Mansukhani LLP; David R. Heckadon

(57) ABSTRACT

A leg press exercise machine, including: a main frame with first and second rotating bars connected thereto; a support assembly connected to each of the first and second rotating bars, wherein rotation of the first and second rotating bars causes the support assembly to move with respect to the main frame; a seat support bar; and a seat mounted onto the seat support bar, wherein the support assembly holds the seat support bar at a downward angle and wherein the rotating bars are disposed at an angle from 0 to 30 or about 20 degrees to the vertical when the machine is in its rest position.

17 Claims, 11 Drawing Sheets

(56) References Cited

U.S. PATENT DOCUMENTS

| | | | | |
|---|---|---|---|---|
| 5,570,957 | A | 11/1996 | Kuly et al. | |
| 5,628,715 | A | 5/1997 | Simonson | |
| 6,220,993 | B1 | 4/2001 | Sencil | |
| 7,794,372 | B1 | 9/2010 | Webber et al. | |
| 7,981,011 | B1 | 7/2011 | Batca | |
| 2002/0013199 | A1 | 1/2002 | Giannelli et al. | |
| 2004/0009857 | A1* | 1/2004 | Webb | A63B 21/0628 482/100 |
| 2004/0023762 | A1* | 2/2004 | Lull | A63B 23/0405 482/100 |
| 2005/0020416 | A1 | 1/2005 | Leipheimer | |
| 2006/0148625 | A1* | 7/2006 | Garner | A63B 21/00 482/123 |
| 2016/0082315 | A1 | 3/2016 | Carter et al. | |
| 2017/0080287 | A1* | 3/2017 | Jaquish | G16H 20/30 |

* cited by examiner

LEG PRESS EXERCISE MACHINE

RELATED APPLICATION

The present invention claims priority to U.S. Provisional Patent Application 62/644,829, of same title, filed Mar. 19, 2018, the entire disclosure of which is incorporated herein by reference in its entirety for all purposes.

TECHNICAL FIELD

The present invention relates to leg press exercise equipment.

BACKGROUND OF THE INVENTION

U.S. Pat. No. 5,554,086 to Habing describes a leg press machine in which a user sits and presses down on two foot pads to lift their seat. Unfortunately, Habing has several limitations, including the fact that its seat is not adjustable back and forth on the support below. As such, shorter users are forced to begin the exercise with their legs comparatively more straightened out, whereas taller users will be forced to begin the exercise with their legs comparatively more crunched up towards their belly. As such, Habing is not adjustable to accommodate users having different body types and dimensions. In addition, Habing's seat is inclined at a steep angle (approximately 30 degrees) to the ground both when starting and when finishing the leg press exercise. This geometry has the disadvantage of making the resistance on the user's legs become too heavy too quickly (as the user straightens their legs).

SUMMARY OF THE INVENTION

The present system provides an improved leg press exercise machine ideally suited for attachment to a cable weight stack. In preferred embodiments, the present leg press machine comprises: a main frame; a first rotating bar connected at one end to the main frame; a second rotating bar connected at one end to the main frame; a support assembly connected to each of the first and second rotating bars, wherein rotation of the first and second rotating bars causes the support assembly to move with respect to the main frame; a seat support bar; and a seat mounted onto the seat support bar.

Advantageously, the preferred length of the present rotating bars combined with their preferred angle to the vertical (when the device is sitting in its rest position) provides a preferred range of motion for most users in which the resistance to motion is neither too high nor too low. As a result, the overwhelming majority of users receive an optimal "push back" from the machine over a preferred range of motion. In various preferred embodiments, the rotating bars are disposed at an angle from 0 to 30 degrees, and more preferably 5 to 15 degrees, and most preferably about 10 degrees to the vertical when the machine is in its rest position.

Advantageously, the support assembly holds the seat support bar at a downward angle from a line passing through the locations where the first and second rotating bars are connected to the support assembly. Preferably, this downward angle is between 20 and 60 or more preferably between 30 to 50 degrees. In addition, the seat is preferably mounted to sit horizontally onto the seat support bar. Advantageously, the downward angle of the seat support bar defines the angle of the seat but does not define its trajectory of movement.

Instead, the trajectory of the seat moves at a shallower angle than the seat is mounted. An advantage of having the seat support bar be angled to the horizontal is that the seat is biased to move forwardly, thereby eliminating the need for a gas spring or other system to return the seat to a forward position after a user has moved it backwards on the support bar. Moreover, in contrast to the Habing system, the present system's rotating bars are also longer (and therefore move through a much smaller angle of curvature from the start to the end of the leg press exercise). Together, all this has the advantage of preventing the user from swinging too far upwardly during the exercise. As a result, the combined weight of the user and the support frame does not become too heavy too quickly as the user straightens their legs during the leg press exercise. In addition, the present geometry also keeps the user generally parallel to the ground throughout the exercise.

In various preferred aspects of the present system, the rotating bars are angled 0 to 30 degrees, and more preferably 5 to 15 degrees (and most preferably about 10 degrees) to the vertical at the start of the leg press exercise. The greater this angle, the heavier the exercise gets. Conversely, the shallower the angle, the bigger the overall machine becomes. As can be seen, the first and second rotating bars are spaced significantly farther apart than in the Habing system. As a result of this different physical design, the entire present structure is stronger (due to both lower torque loading both where the rotating bars connect to the main frame and where they connect to the seat support bar).

As mentioned above, the seat is adjustably mounted onto the seat support bar such that the seat is moveable forwards and backwards along the seat support bar. This has the advantage of accommodating users of different body shapes and leg lengths. As such, users with longer legs do not have to start the leg press with their legs too crunched up towards their chest (which would put unnecessary stress on their legs and strain on their lower back), and users with shorter legs do not have to start the leg press with their legs too extended (thereby limiting the full range of motion that they can achieve with the device). An additional advantage of the adjustable seat is that a user can push themselves far enough away from the footplate to perform a calf raise exercise.

In preferred aspects, the support assembly is generally triangular in shape with the first and second rotating bars connected to first and second points of the triangle, and the seat support bar connected to the third point of the triangle.

The exercise machine also preferably includes full width footplate mounted to the main frame. Advantages of using a full width footplate are that the user can perform the leg press using a variety of foot positions (such as a narrower or wider stance, and with their feet positioned higher or lower relative to their hips). The footplate is advantageously positioned at a height such that the user's feet are positioned higher than the seat at the start (and optionally the end) of the leg press exercise. In addition, the top end of the first rotating bar is preferably positioned above the user's hips at the end of the leg press exercise. Taken together, this geometry has the advantage of preventing the resistance on the user's legs from becoming too heavy too quickly, thereby preventing unnecessary stress on the user's legs and unnecessary strain on the user's lower back.

DETAILED DESCRIPTION OF THE DRAWINGS

Figure 1:
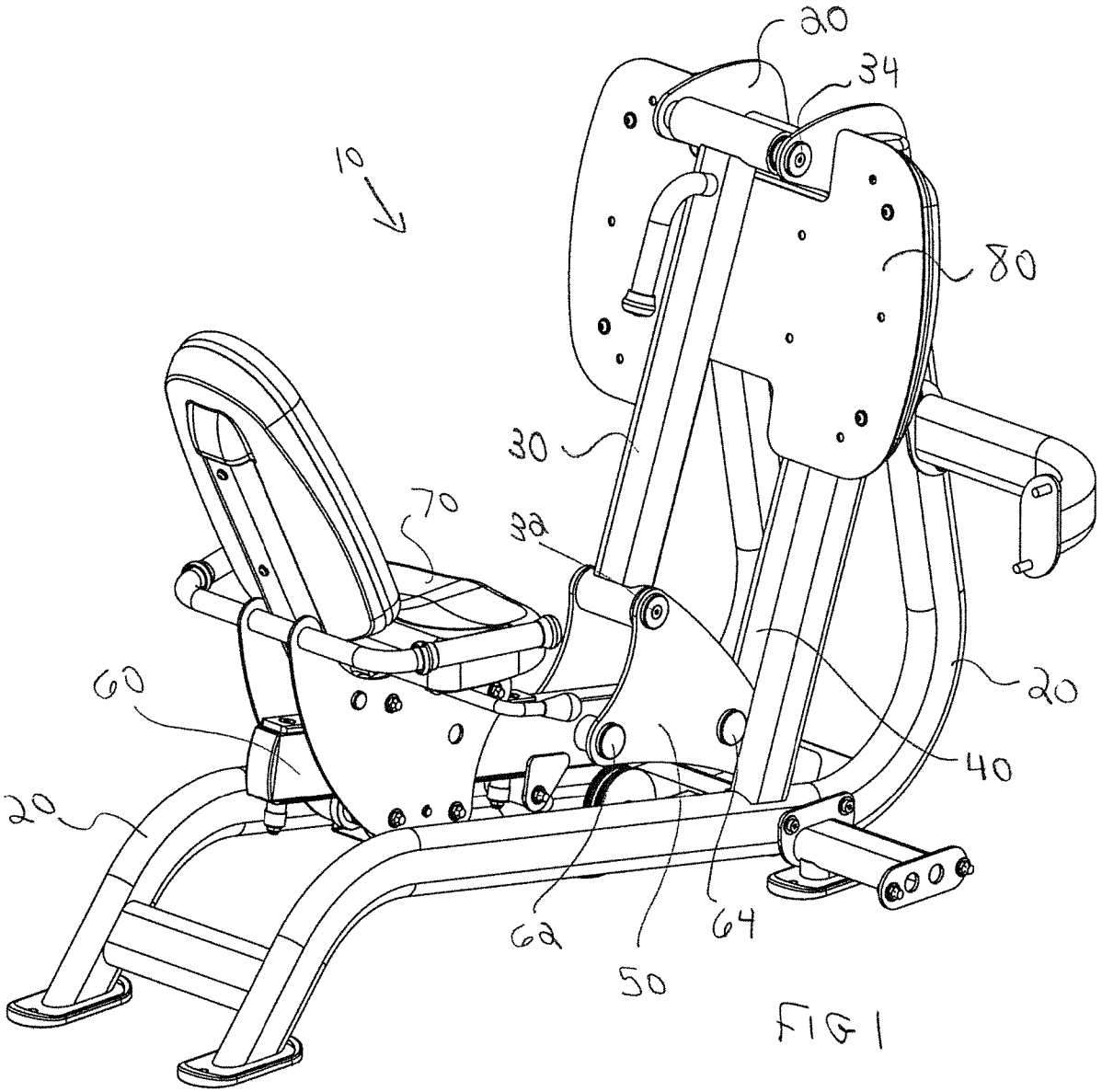
FIG. 1 is a rear side perspective view of the leg press.

Referring to the attached Figures, a leg press exercise machine 10 is provided. Leg press exercise machine 10 comprises: a main frame 20; a first rotating bar 30 connected at one end to main frame 20; a second rotating bar 40 connected at one end to main frame 20; a support assembly 50 is connected to first and second rotating bars 20 and 30, as shown. Rotation of first and second rotating bars 20 and 30 causes support assembly 50 to move with respect to main frame 20. This rotational movement of bars 20 and 30 can be seen by comparing FIG. 6 (which is the start position of the leg press exercise) to FIG. 7 (which is the end position of the leg press exercise). Leg press exercise machine 10 further comprises a seat support bar 60 and a seat 70 mounted onto seat support bar 60.

Figure 2:
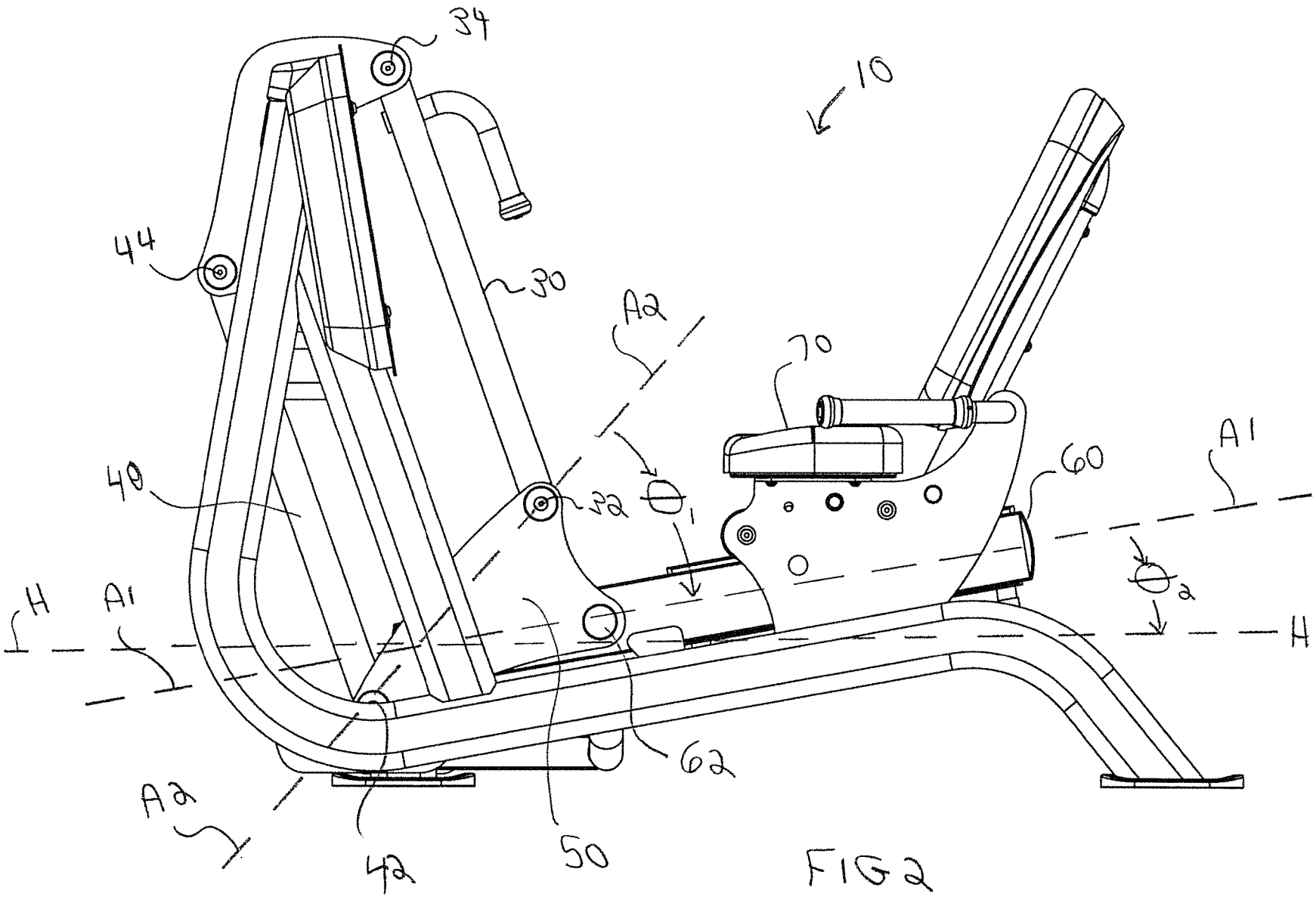
FIG. 2 is a left side elevation view of the leg press.

In accordance with the present system, support assembly 50 preferably holds seat support bar 60 at a downward angle. Specifically, as seen in FIG. 2, axis A1 passes along through seat support 60. First rotating bar 30 is connected to support assembly 50 at pivot point 32. Second rotating bar 40 is connected to support assembly 50 at pivot point 42. A line passing through the locations where the first and second rotating bars are connected to the support assembly (i.e.: through points 32 and 42) defines a second axis A2. In accordance with the present system, axis A1 is downwardly angled from axis A2 by angle $\Theta_1$. In preferred aspects, angle $\Theta_1$ is between 20 to 60 degrees. More preferably, angle $\Theta_1$ is between 30 to 50 degrees. A horizontal axis H is also shown. In preferred aspects, support assembly 50 holds seat support bar 60 at an angle $\Theta_2$ to the horizontal. In preferred aspects, angle $\Theta_2$ is between 10 to 30 degrees.

Figure 3:
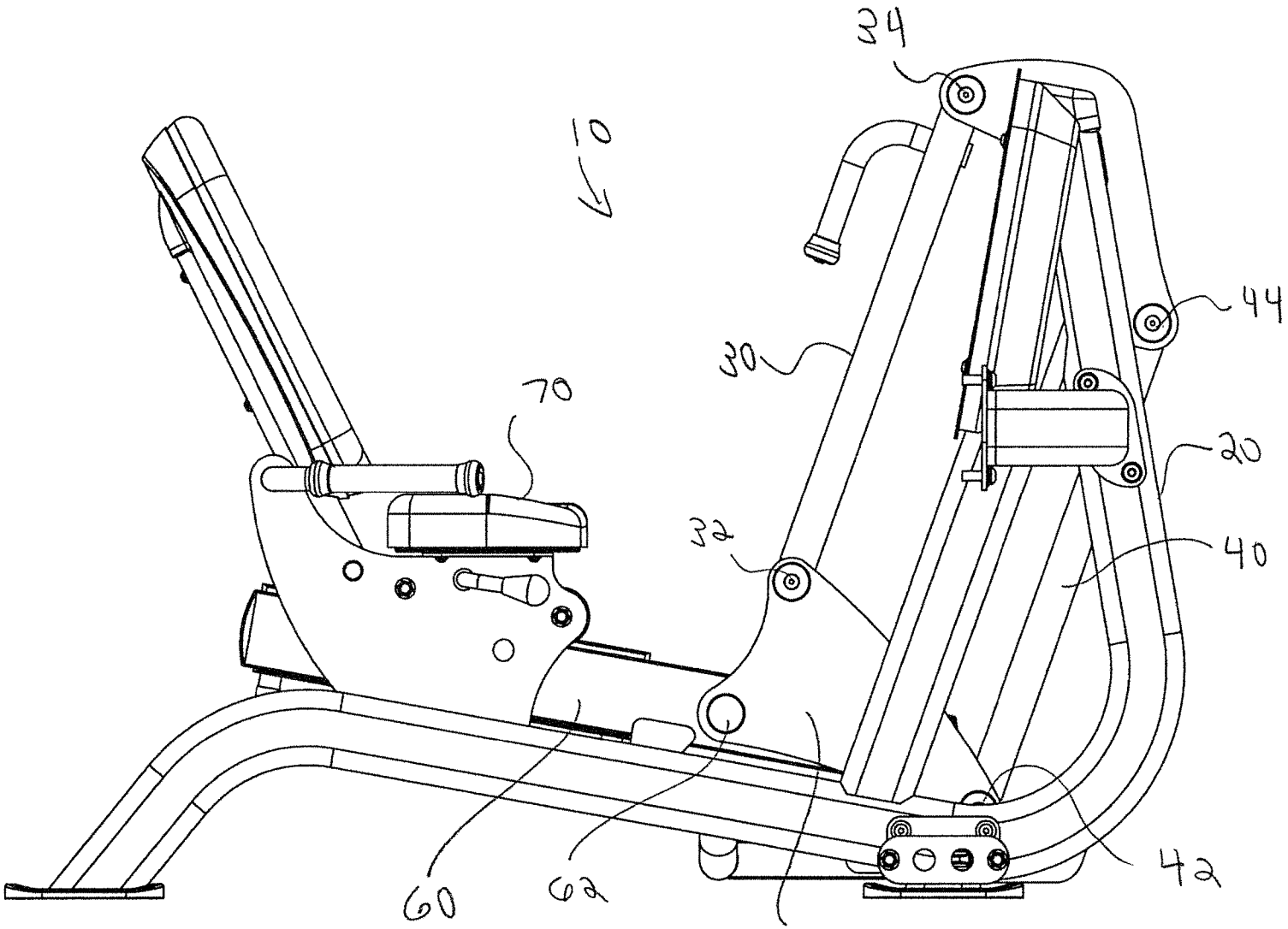
FIG. 3 is a right side elevation view of the leg press.
Figure 4:
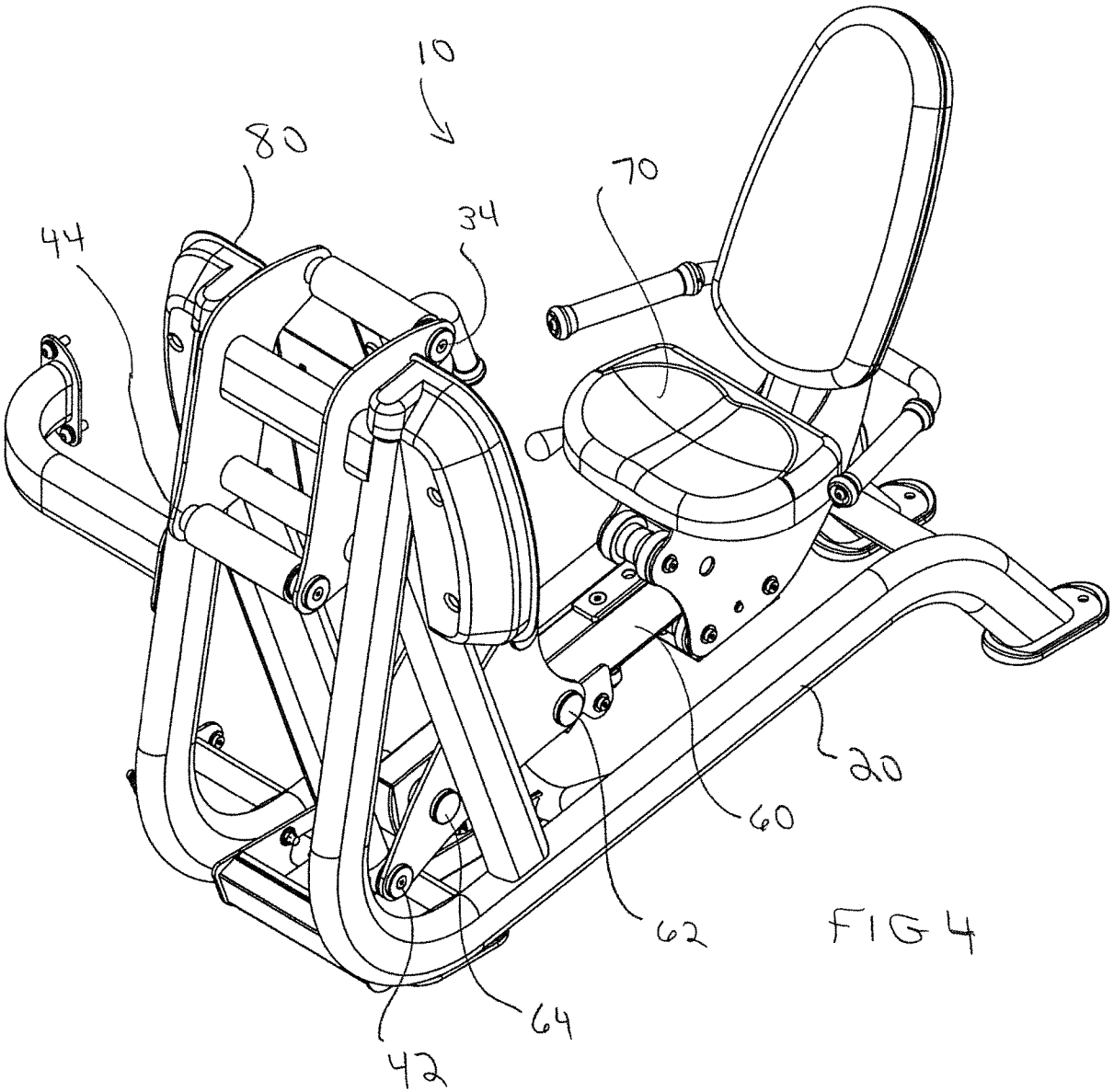
FIG. 4 is a front side perspective view of the leg press.
Figure 10:
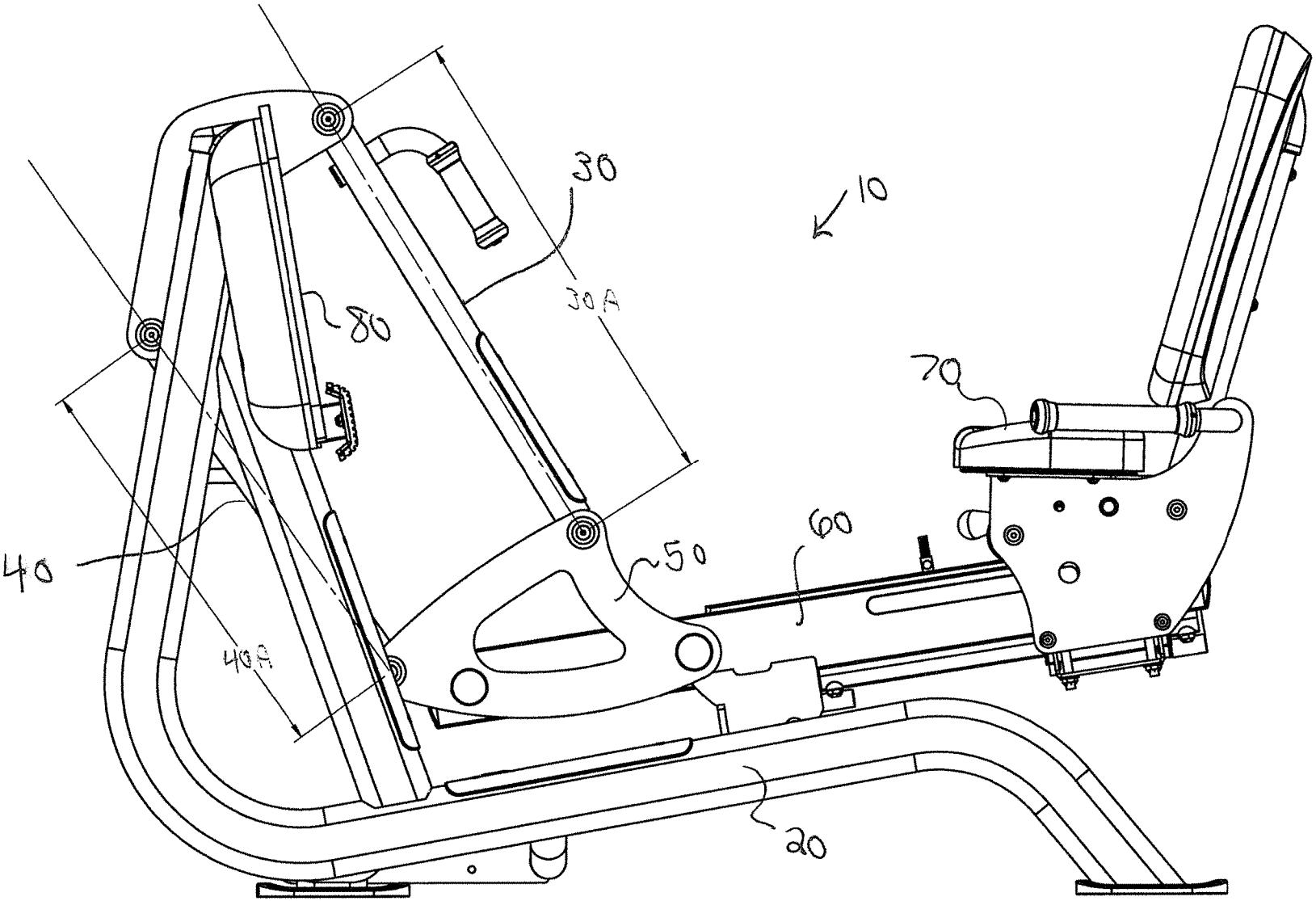
FIG. 10 is a side elevation view corresponding to FIG. 9, but at the exercise finish position.

As seen in FIGS. 2 and 3, seat 70 is preferably mounted onto seat support bar 60 such that seat 70 is positioned horizontally (i.e.: generally parallel to the ground). As can be seen in FIGS. 10 and 11, seat 70 remains horizontal throughout a full leg press exercise. This provides ample comfort to the user during the exercise.

A further advantageous feature of the present exercise machine is that seat 70 is adjustably mounted onto the seat support bar 60 such that seat 70 is moveable forwards and backwards along seat support bar 60 (i.e.: seat 70 can be moved back and forth along axis A1 to accommodate users of different leg lengths. Having the seat moveable along axis A1 at angle $\Theta_2$ to the horizontal will tend to return seat 70 to a forward position, thereby avoiding the need for a spring to pull the seat 70 forward when readjusting the position of seat 70 for different users.

First rotating bar 30 is pivotally connected to support assembly 50 at point 32 and is pivotally connected to frame 20 at point 34. Similarly, second rotating bar 40 is pivotally connected to support assembly 50 at point 42 and is pivotally connected to frame 20 at point 44. As can be seen in the Figures, first and second rotating bars 30 and 40 are positioned parallel to one another and remain parallel to one another when moved.

Figure 5A:
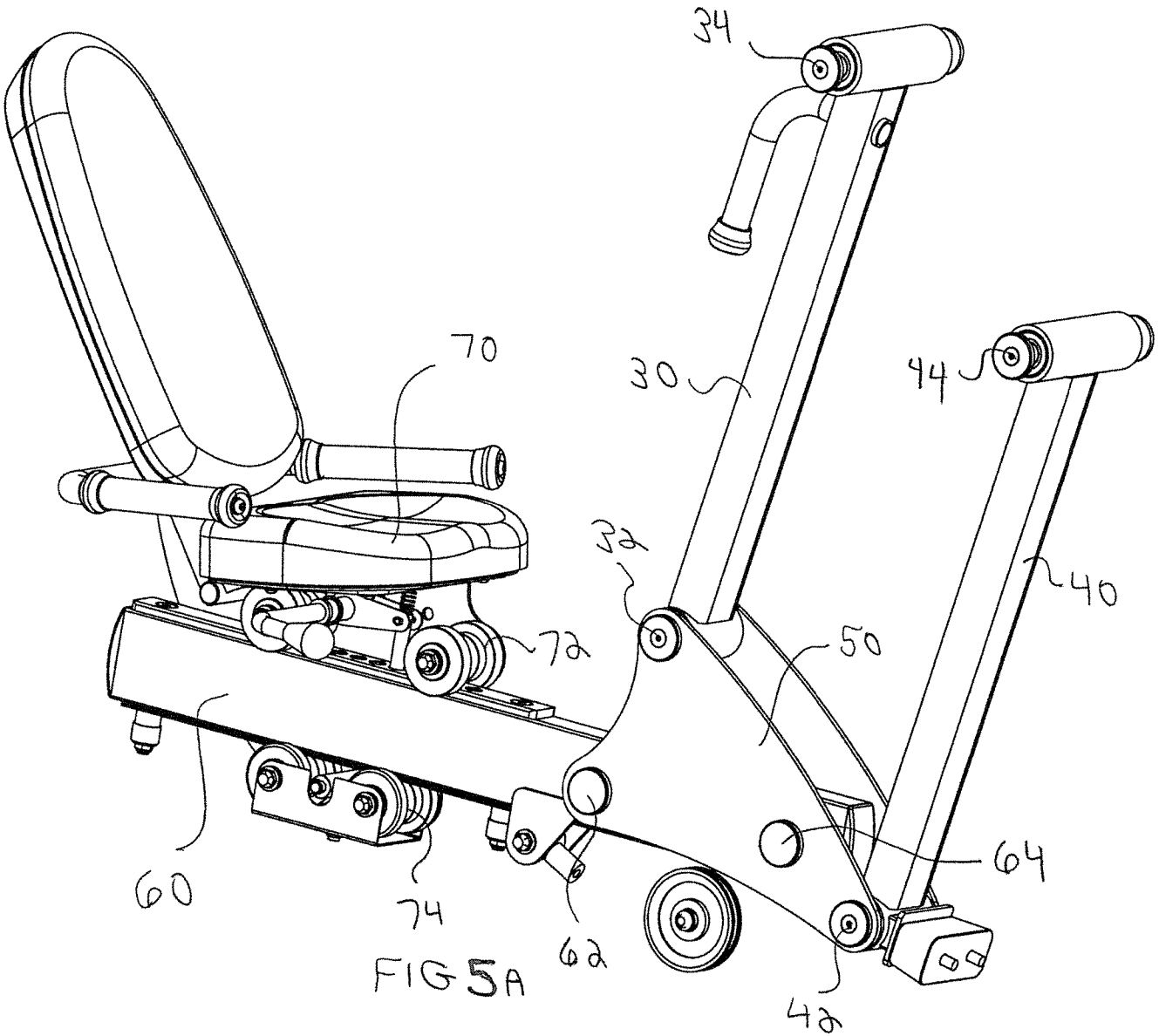
FIG. 5A is a partial perspective view of the leg press.

As seen most clearly in FIG. 5A, support assembly 50 is generally triangular in shape and the first and second rotating bars 30 and 40 are connected to first and second points of the triangle (at 32 and 42). As can also be seen, seat support bar 60 can be connected to a third point of the triangle (at non-rotational point 62) and also at non-rotational point 64. Thus, seat support bar 60 can be connected to support assembly 50 at two or more locations (62 and 64).

Figure 5B:
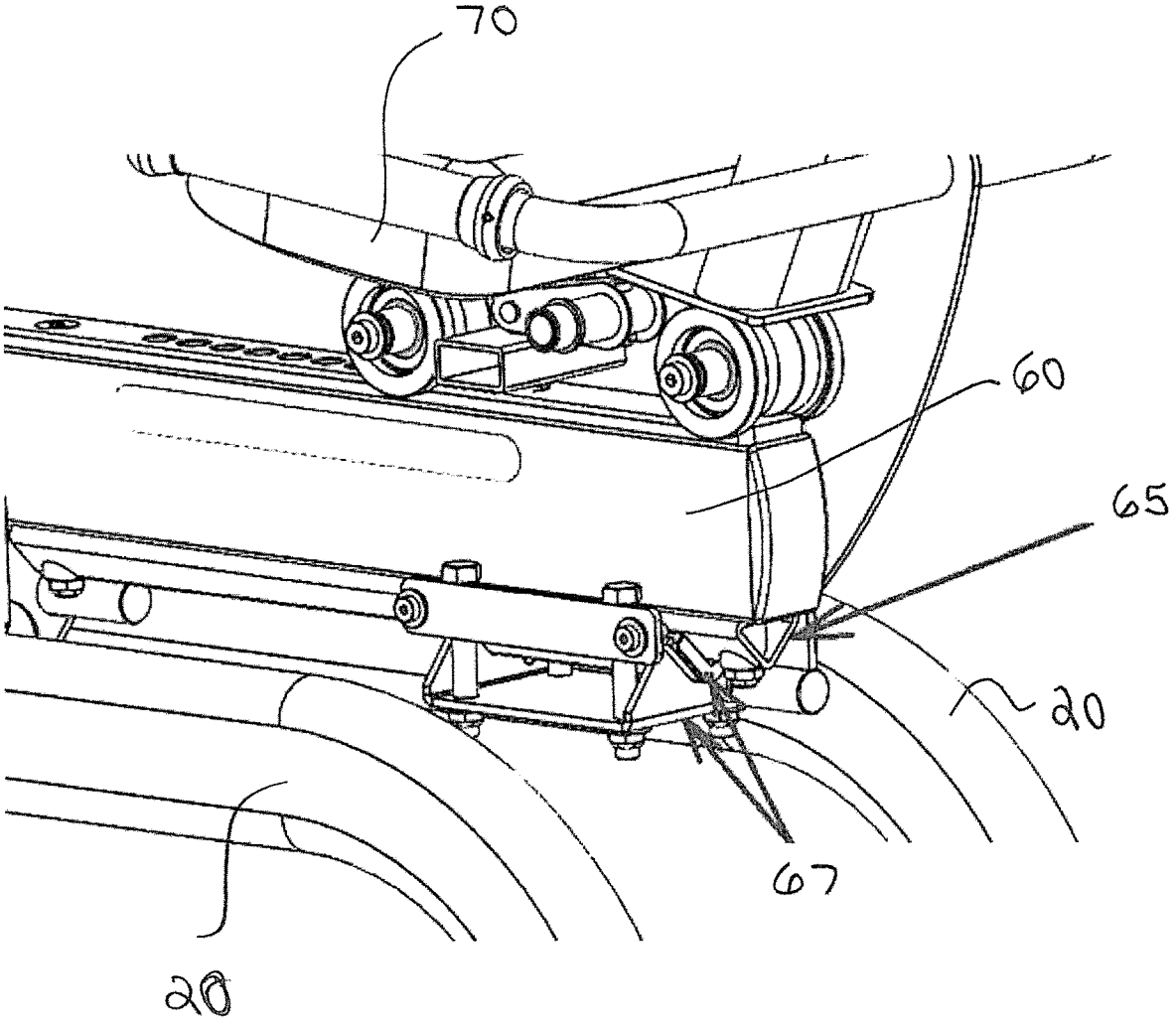
FIG. 5B is a rear perspective view similar to FIG. 5A, but showing a slightly different embodiment of how the seat is connected to the support bar.

FIG. 5A also shows further details of seat 70, specifically top wheels 72 and bottom wheels 74 for moving seat 70 back and forth along seat support bar 60 to a desired position to accommodate the particular leg length of the user. FIG. 5B shows an alternate embodiment where seat 70 is connected to support bar 60 with a triangular aluminum extrusion 65 resting in an adjustable bracket with V-shaped plastic bushings 67.

The present leg press exercise machine 10 also includes a footplate 80 mounted to main frame 20. The novel positioning of footplate 80 provides advantages to the user in that unwanted stress on the user's legs and back is avoided. For example, footplate 80 are positioned at a height on main frame 20 such that the user's feet are positioned higher than seat 70 at the start position of the leg press exercise (see FIG. 6). Moreover, footplate 80 is also positioned at a height on main frame 20 such that the user's feet are even positioned higher than seat 70 at the end position of the leg press exercise (see FIG. 7). As can also be seen in FIG. 7, top end (location 34) of first rotating bar 30 is positioned above the user's hips at the end of the leg press exercise.

Exercise machine 10 is ideally suited for use with a cable weight stack (weight stack not shown). Preferably, the weight stack is positioned in front or to the side of the seated user. A cable 90 can be connected from the weights being lifted to the bottom of seat support bar 60 (See FIG. 7). As the user performs the leg press, (s)he pushes down on footplate 80, thereby pulling cable 60, lifting the weight(s) supported at the opposite end of the cable.

Figure 6:
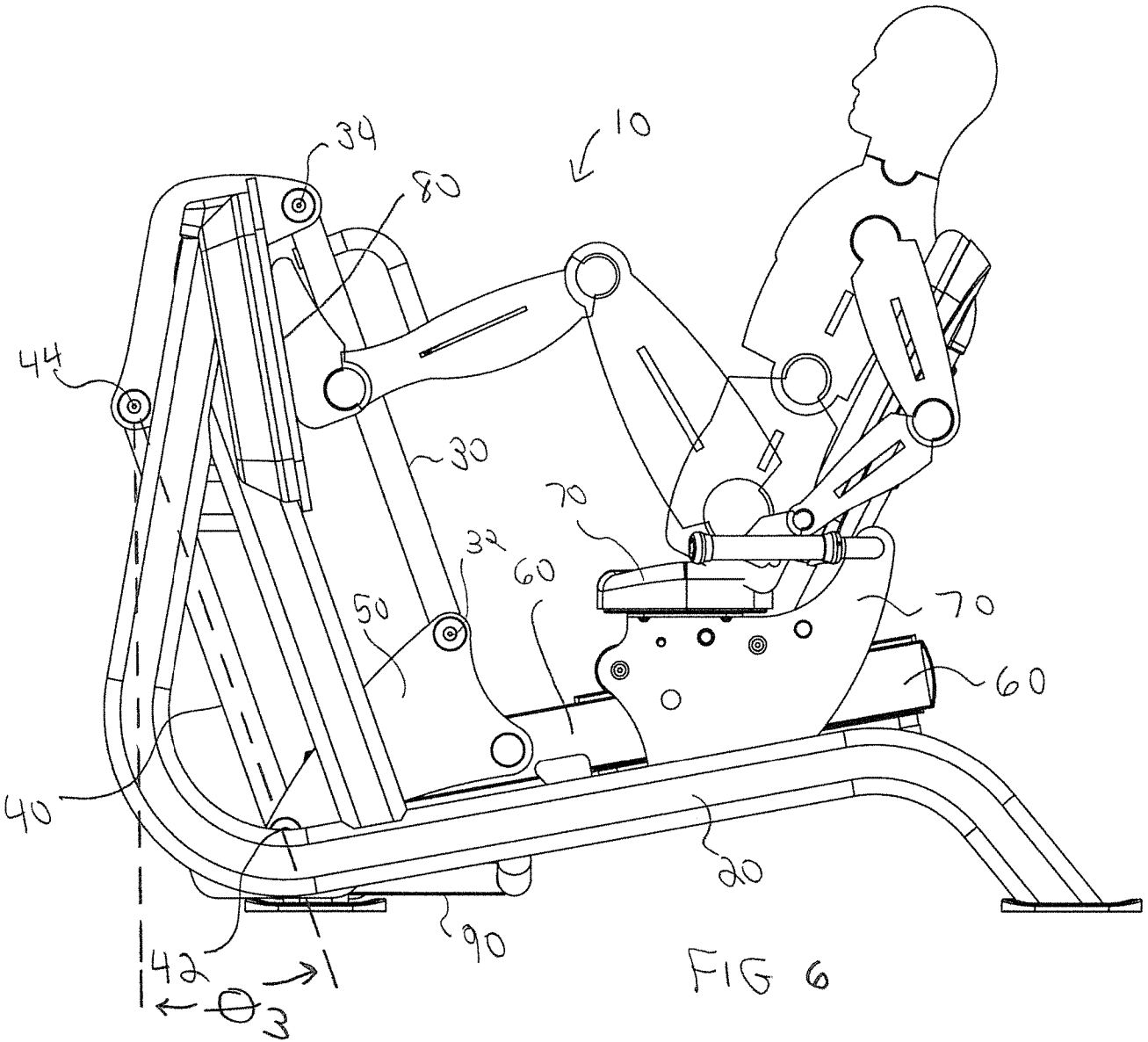
FIG. 6 is a side elevation view showing a user starting the leg press, showing preferred angles and positions for the rotating bars at the start of the leg press exercise.
Figure 7:
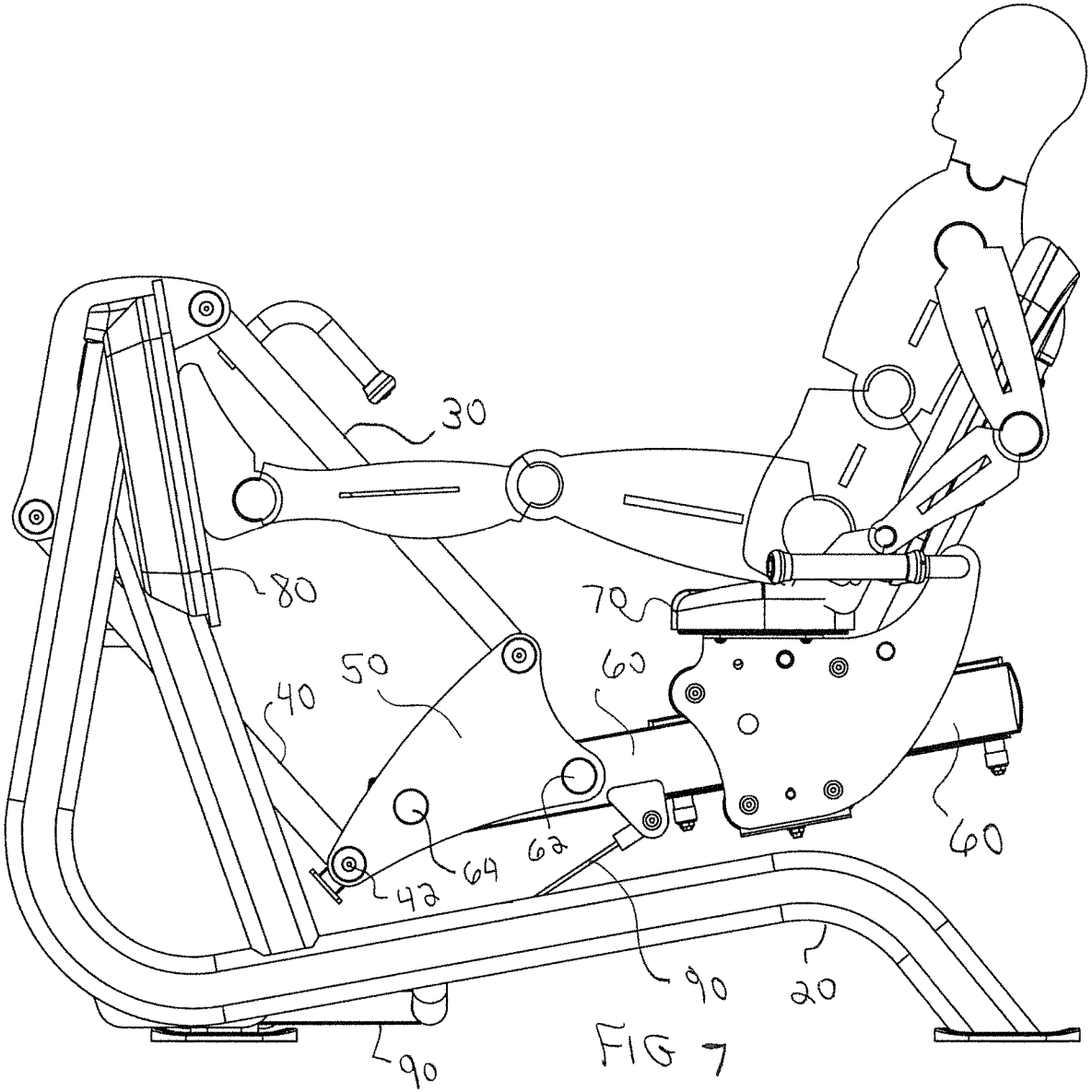
FIG. 7 is a side elevation view showing the user finish the leg press.

FIG. 6 shows preferred angles and spacings for rotating bars 30 and 40, as follows. Angle $\Theta_3$ shows the angle between second rotating bar 40 and a vertical axis V (which is also the same angle between first rotating bar 30 and a vertical axis). In preferred aspects, rotating bars are angled 0 to 30 degrees, or more preferably 5 to 15 degrees, (or most preferably about 10 degrees) to vertical axis V at the start of the leg press exercise, as shown. The greater angle $\Theta_3$, the heavier the exercise gets. Conversely, the shallower angle $\Theta_3$, the bigger the overall machine becomes.

Preferably as well, the first and second rotating bars 30 and 40 are spaced significantly farther apart than in the Habing system. As a result, the entire structure is stronger (due to both lower torque loading both where the rotating bars connect to the main frame at 34 and 44, and also where the rotating bars 30 and 40 connect to the seat support bar at 32 and 42).

Figure 8:
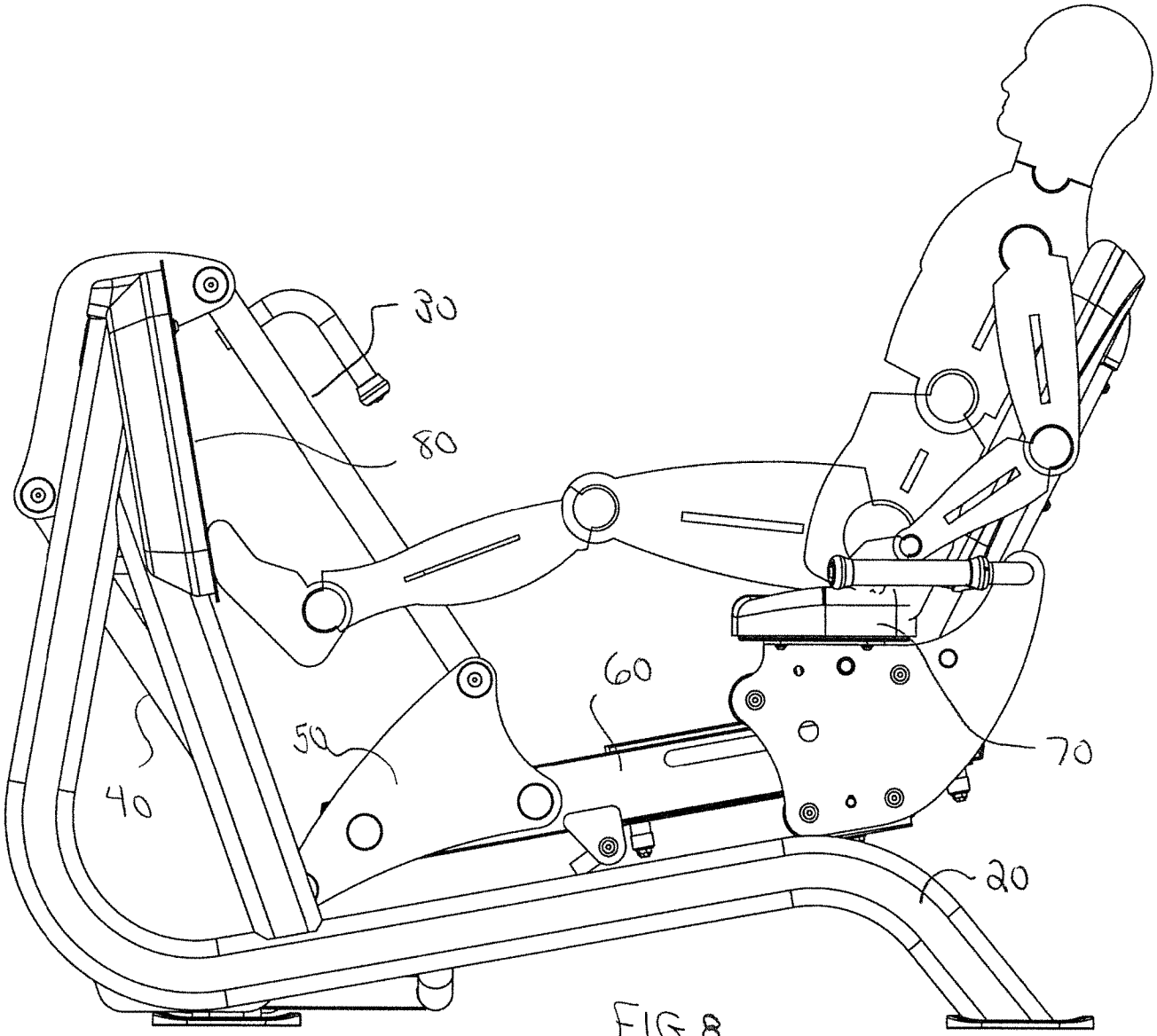
FIG. 8 is a rear perspective view of a system for mounting the seat on the seat support bar.

In addition to performing a leg press exercise, the user may also perform a calf press exercise as seen in FIG. 8 (where the user keeps her/his legs extended as shown and rotates his/her ankles to slightly raise/lower and move back/forth seat 70, thereby exercising the user's calf muscles.

Figure 9:
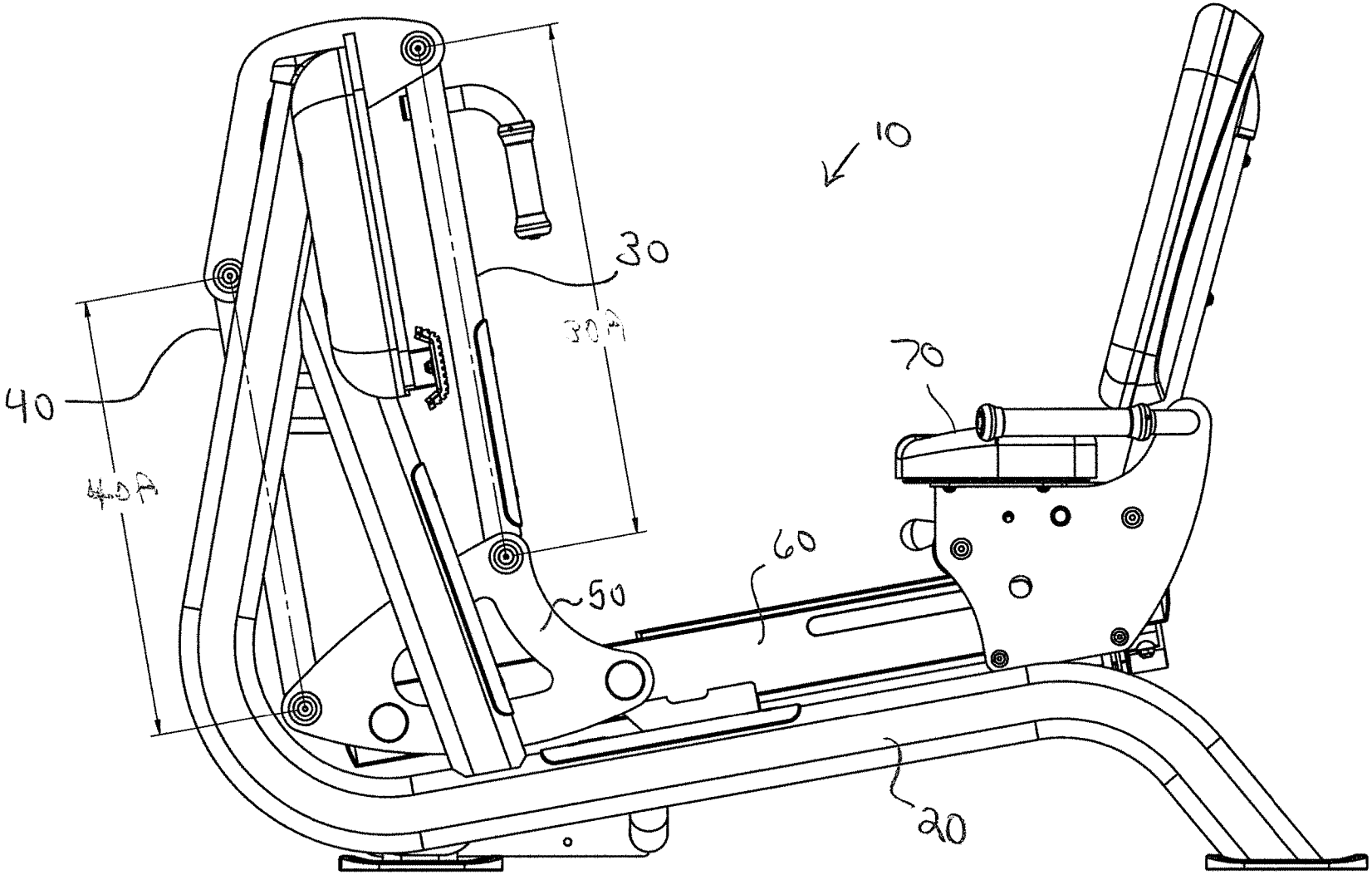
FIG. 9 is a side elevation view of an alternate embodiment of the present system, instead having rotating bars of unequal lengths at an exercise start position.

FIGS. 9 and 10 are side elevation views of an alternate embodiment of the present system, instead having rotating bars 30 and 40 of unequal lengths. Specifically, length 30A is slightly longer than length 40A. Using this geometry of unequal bar lengths, the user's trajectory is more level, making the initial lifting at the start of the exercise feel lighter on the user. This beneficially manages the weight of the parts of the present system and gives a favorable rate of increase to a user as the user pushes away from the footplate 80. It is to be understood therefore, that the present system encompasses both versions where rotating bars 30 and 40 are the same length or are of unequal lengths. In preferred embodiments, bar 30 (i.e.: the rotating bar closest to the user), is longer than bar 40. This has the advantageous effect of lowing the angle of the seat 70 relative to the horizontal (i.e.: decreasing angle $\Theta_1$). This increases user comfort.

What is claimed is:

1. A leg press exercise machine, comprising:

a main frame;

a stationary footplate attached to the main frame;

a first rotating bar connected at a top end to the main frame;

a second rotating bar connected at a top end to the main frame;

a support assembly connected to bottom ends of each of the first and second rotating bars, wherein rotation of the first and second rotating bars causes the support assembly to move with respect to the main frame;

a seat support bar connected to the support assembly;

a seat mounted onto the seat support bar, wherein the stationary footplate is positioned above the seat throughout a leg press exercise, wherein the support assembly holds the seat support bar at a downward angle from a line passing through the locations where the bottom ends of the first and second rotating bars are connected to the support assembly, and wherein the first and second rotating bars are disposed at an angle to a vertical axis when the exercise machine is in its rest position.

2. The exercise machine of claim 1, wherein the angle to the vertical axis is between 0 to 30 degrees.

3. The exercise machine of claim 2, wherein the angle to the vertical axis is 5 to 15 degrees.

4. The exercise machine of claim 1, wherein the seat is mounted to sit horizontally onto the seat support bar.

5. The exercise machine of claim 4, wherein the seat remains horizontal throughout the leg press exercise.

6. The exercise machine of claim 1, wherein the support assembly holds the seat support bar at an angle of 10 to 30 degrees inclined from horizontal.

7. The exercise machine of claim 1, wherein the downward angle is from 20 to 60 degrees.

8. The exercise machine of claim 1, wherein the seat is adjustably mounted onto the seat support bar such that the seat is moveable forwards and backwards along the seat support bar.

9. The exercise machine of claim 1, wherein the first and second rotating bars are positioned parallel to one another and remain parallel to one another when moved.

10. The exercise machine of claim 1, wherein the support assembly is triangular in shape.

11. The exercise machine of claim 1, wherein the seat support bar is connected to the support assembly at two or more locations.

12. The exercise machine of claim 1, wherein the seat remains parallel to a ground during the leg press exercise.

13. The exercise machine of claim 1, wherein the top end of the first rotating bar is configured to be positioned above a user's hips at an end of the leg press exercise.

14. The exercise machine of claim 1, further comprising: a cable attached to a bottom of the seat support bar.

15. The exercise machine of claim 1, wherein the seat is mounted onto the seat support bar with an adjustable bracket and plastic bushing.

16. The exercise machine of claim 1, wherein the first and second rotating bars are of equal lengths.

17. The exercise machine of claim 1, wherein the first and second rotating bars are of unequal lengths, and the rotating bar configured to be closest to a seated user performing the leg press exercise is the longer of the first and second rotating bars.

* * * * *